US005169348A

United States Patent [19]

Ogiwara et al.

[11] Patent Number: 5,169,348

[45] Date of Patent: Dec. 8, 1992

[54] AUTOMATIC PLANING CONTROL SYSTEM

[75] Inventors: Kazuyuki Ogiwara; Hitoshi Kotajima, both of Gunma, Japan

[73] Assignee: Sawafuji Electric Co., Ltd., Tokyo, Japan

[21] Appl. No.: 540,646

[22] Filed: Jun. 19, 1990

[30] Foreign Application Priority Data

Jun. 21, 1989 [JP] Japan ..... 1-159163
Dec. 26, 1989 [JP] Japan ..... 1-149651[U]
Dec. 26, 1989 [JP] Japan ..... 1-149652[U]
Dec. 26, 1989 [JP] Japan ..... 1-149653[U]

[51] Int. Cl.[5] ..... B63H 21/26
[52] U.S. Cl. ..... 440/1; 440/53
[58] Field of Search ..... 440/1, 2, 61-63, 440/900, 53; 361/18, 28, 29

[56] References Cited

U.S. PATENT DOCUMENTS 4,042.964 8/1977 Nurnberg et al. ..... 361/28
4,976,636 12/1990 Torigai ..... 440/1

FOREIGN PATENT DOCUMENTS 038096 2/1988 Japan ..... 440/1

*Primary Examiner*—Edwin L. Swinehart
*Attorney, Agent, or Firm*—McGlew & Tuttle

[57] ABSTRACT

The present invention describes a system for controlling the planing angle of a boat powered by an outboard motor. Sensors are provided which measures the inclination of the propeller of the boat and the acceleration of the boat. An angle-changing motor is mounted between the outboard motor and the boat and a motor control means receives signals from the angle sensor and the acceleration sensor in order to control the angle between the propeller and the boat. Other sensors can be applied to detect the angle between the outboard motor and the boat in order to prevent excessive angles from occurring. A timer can also be used to nullify the effects of the acceleration sensor after a predetermined time.

4 Claims, 7 Drawing Sheets

AUTOMATIC PLANING CONTROL SYSTEM

BACKGROUND OF THE INVENTION

This invention relates to an automatic planing control system for motor boats equipped with outboard motors. The control keeps the outboard motor propeller axis parallel with the surface of the water, or at a predetermined angle, wherever possible when the motor boat is running at a constant speed or being accelerated. Also the planing control protects the outboard motor at the down-blow state. This invention also relates to an FET bridge protection circuit in the automatic planing control system for setting the propeller of the outboard motor at a predetermined angle.

In the present Specification, the word planing means to lift partly the boat body out of the water to an appropriate degree, rather than bringing the boat body to the state of hump.

DESCRIPTION OF THE PRIOR ART

In order to efficiently and comfortably run a motor boat equipped with an outboard motor, it is desirable to keep the attitude of a boat body 10 parallel to the surface of the water wherever possible, as shown in FIG. 7(1). In a steady-state, or constant-speed operation, a propeller 12, for for generating thrust to move the boat body 10 forward, is desired to have an axis parallel to or at a predetermined angle with respect to the horizontal plane even when the bow rises, as shown in FIG. 7(2), or when the bow dips, as shown in FIG. 7(3) or (4).

When the motor boat is driven at an accelerating rate, the bow rises. In such a state, efficient acceleration cannot be accomplished because the direction of the thrust caused by the propeller to move the boat body 10 forward is misaligned with the direction of travel of the boat, as shown in FIG. 7(2).

To cope with this problem, certain types of motor boats are equipped with a trim device for manually adjusting the angle between the outboard motor 11 and the boat body 10 (that is, the angle between the propeller 12 and the boat body 10). In the trim device, the boat body 10 and the outboard motor 11 are connected with a hydraulic cylinder so that the angle between the boat body 10 and the outboard motor 11 can be changed by operating the hydraulic angle-changing cylinder with a hydraulic motor. Thus, the boat body 10 is kept level by manually turning on and off the hydraulic angle-changing motor and changing over the direction of revolution of the angle-changing motor.

In other words, when the motor boat is being accelerated. the outboard motor 11 is temporarily tilted in the DOWN direction, as shown in FIG. 7(9), to cause the boat body 10 to level, and after the boat body has been made level, as shown in FIG. 7(7), the outboard motor 11 is returned from the DOWN direction to the vertical direction, as shown in FIG. 7(5).

In FIG. 7 illustrating the relationship between the motor boat and the outboard motor, the state shown in FIG. 7(5) is the standard state. The state shown in FIG. 7(6) is a state where the outboard motor 11 is tilted upward (UP) to cause the bow of the boat body 10 to lift, while the state shown in FIG. 7(7) is a state where the outboard motor 11 is tilted downward (DOWN) to cause the bow to droop.

Aside from the fact that the bow tends to lift when running at an accelerate rate, the bow sometimes lifts for some reason or other when travelling at a constant speed. In such an event, it is desirable to temporarily tilt the outboard motor 11 in the UP direction, as shown in FIG. 7(8), to maintain the boat body 10 in the state shown in FIG. 7(3), rather than tilting the outboard motor 11 in the DOWN direction, as shown in FIG. 7(9) when the boat is being accelerated.

The prior art has a problem in that it is difficult to quickly perform the above operation by hand by quickly and correctly judging the state described above.

To overcome the above problem, an automatic trim control device has been used. FIG. 8 is a diagram illustrating an automatic trim control device used in the prior art. By turning on and off a changeover switch 21, the mode is changed over from automatic control to manual control and vice versa.

In the following, the automatic trim control device used in the piror art will be described, referring to FIG. 8.

When a changeover switch 21 is turned on, the control mode is switched to automatic control, in which the voltage of a battery 22 energize relays 23 and 24, connecting the relays 23 and 24 to the respective A contacts thereof. As FET transistors ② and ④ forming a pair in an FET bridge circuit section 25 are driven by a pulse width modulation signal which changes in accordance with the inclination of a motor boat (not shown), the FET transistors ② and ④ are turned on only for that duration. Consequently, a circuit is formed among the positive terminal of the battery 22, the FET transistor ②, the A contact of the relay 23, the motor angle-changing 27 of the outboard motor 11, the A contact of the relay 24, the FET transistor ④ and the negative terminal of the battery 22, and the angle-changing motor 27 is caused to rotate in the forward direction to control the outboard motor 11 in the UP direction.

When the FET transistors ① and ③ are driven by a pulse width modulation signal which changes in accordance with the inclination of the boat, on the other hand, a circuit is formed among the positive terminal of the battery 22, the FET transistor ①, the A contact of the relay 24, the motor 27, the A contact of the relay 23, the FET transistor ③ and the negative terminal of the battery 22, and the angle-changing motor 27 is caused to rotate in the reverse direction to control the outboard motor 11 in the DOWN direction. When the changeover switch 21 is turned off, to the contrary, the control mode is switched to manual control, and the voltage of the battery 22 is fed to the outboard motor 11. At this time, the relays 23 and 24 are connected to their respective B contacts.

When controlling the outboard motor 11 in the UP direction in the manual control mode, the terminals X and Y of the changer 28 are connected to the positive and negative terminals of the battery 22, respectively, to cause the angle-changing motor 27 to rotate in the forward direction via the B contacts of the relays 23 and 24. When controlling the outboard motor 11 in the DOWN direction, the terminals X and Y of the changer 28 are connected to the negative and positive terminals of the battery 22, respectively, causing the angle-changing motor 27 to rotate in the reverse direction via the B contacts of the relays 23 and 24.

Numeral 29 refers to a circuit power supply terminal board, 30 to a detecting resistor, and 31 to a capacitor.

FIG. 8 illustrates the prior art in which the trim angle is adjusted by tilting the outboard motor 11 upward or downward, when the control mode is switched to the manual control mode by turning off the changeover switch 21. In the circuit of FIG. 8, the voltage of the battery 22 is always applied to the FET bridge circuit section 25. In such a state, any of the FET transistors ① through ④ may be destroyed if a certain signal is applied to the FET bridge circuit section 25.

When the control mode is switched to the automatic control mode by turning on changeover switch 21, it takes approximately one second before the voltages in the driver circuit for driving the FET transistors ① through ④ and other control circuits in the FET bridge circuit section 25 are stabilized. During this period of time, the output signal of the driver circuit remains unstable. Thus, when the unstable driver circuit output signal is delivered to the FET bridge circuit section 25, any of the FET transistors ① through ④ may be destroyed.

When the automatic trim control device is provided, the propeller, that is the outboard motor 11, is always kept operating in accordance with the attitude and the operating state of the motor boat. This keeps the driving hydraulic angle-changing motor operating to control the outboard motor 11, resulting in increased heat generation, readily triggering the protective thermal switch. Particularly, when acceleration and deceleration are repeated, the likelihood of down blow may be increased. This in turn leads to increase the angle-changing motor current to the maximum, resulting in thermal destruction of the angle-changing motor.

SUMMARY OF THE INVENTION

This invention is intended to overcome the aforementioned problems. To achieve this, the automatic planing control system for motor boats has an angle signal generating circuit for generating an angle signal by detecting the inclination of the boat body, a triangular wave generating circuit, a summing circuit for adding the output level signals of the angle signal generating circuit and the triangular wave generating circuit, an acceleration detecting circuit for detecting whether the boat body is being accelerated by comparing the output level of the angle signal generating circuit with a reference voltage, a comparator circuit for comparing the output level of the summing circuit or the output level of the acceleration detecting circuit with a reference voltage, a driver circuit for driving the angle-changing motor based on the signal created by the comparator circuit as an amplitude corresponding to the inclination of the boat body, and a angle-changing motor control circuit for controlling the motor to change the angle between the outboard motor and the boat body so as to keep the attitude of the outboard motor constant.

The acceleration detecting circuit is capable of detecting the inclination angle of the boat body produced by acceleration.

The acceleration detecting circuit may be equipped with a timer circuit for detecting the continuation of acceleration for more than a predetermined time, and a reset circuit for forcibly reducing the reference voltage of the acceleration detecting circuit in accordance with the detection signal of the timer circuit.

Furthermore, a connecting angle detecting circuit for detecting the connecting angle between the outboard motor and the boat body, and changing the control operation of the driver circuit to stop the operation of the angle-changing motor when the detected angle becomes less than a predetermined connecting angle.

Furthermore, an automatic planing control system for motor boats comprising an angle-changing motor for controlling the attitude of the outboard motor propeller via a hydraulic device, a plurality of relays for changing between automatic and manual control modes of the angle-changing motor, an FET bridge circuit section for supplying voltages to the angle-changing motor for normal and reverse revolution of the angle-changing motor via the contacts of the relays, a changeover switch for changing between automatic and manual control modes, and a power supply, characterized in that the FET bridge circuit section is protected by providing a power feeding relay for supplying power to the FET bridge circuit section and the relays, and a relay timer circuit for providing a time delay in the power feeding relay via the changeover switch.

These and and other objects of this invention will become more apparent by referring to the following description and appended drawings shown in FIGS. 1 through 7.

DETAILED DESCRIPTION OF THE EMBODIMENT

The operating principle of this invention will be described in the following, referring to FIG. 1.

Figure 1:
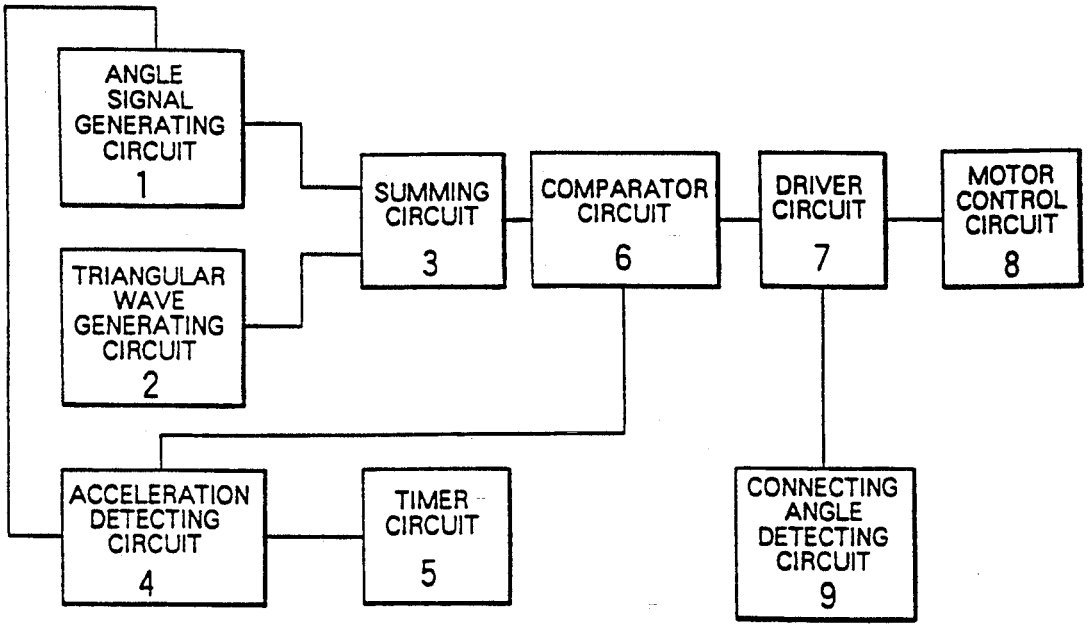
FIG. 1 is a block diagram illustrating the operating principle of this invention.

FIG. 1 is a block diagram illustrating the operating principle of this invention. In the figure, an angle signal generating circuit 1 generates an angle signal by detecting the inclination of a boat body by means of an angle sensor provided on an outboard motor. A triangular wave generating circuit 2 generates a triangular wave; the triangular wave output signal and the angle signal produced in the angle signal generating circuit 1 are added in a summing circuit 3. An acceleration detecting circuit 4 creates an acceleration signal by comparing the output level of the angle signal generating circuit 1 with a reference voltage level of the acceleration detecting circuit 4. The comparator circuit 6 compares the reference voltage level of the comparator circuit 6 with the output level of the summing circuit 3 or the output level of the acceleration detecting circuit 4. A driver circuit 7 is driven based on the pulse width of a signal corresponding to the inclination of the boat body. The signal is created by the comparator circuit 6. The angle between the boat body and the outboard motor is controlled by controlling the motor control circuit 8 to change the direction of revolution of the angle-changing motor.

A connecting angle detecting circuit 9 forcibly changes the control operation of the driver circuit 7 to stop the operation of the angle-changing motor, when the connecting angle between the outboard motor and the boat body, detected by an angle detecting means such as a trim gauge, falls below a predetermined connecting angle.

Next, the operating principle shown in FIG. 1 will be described in the following.

When the motor boat is under way at a constant speed, the inclination of the boat body detected by the angle sensor provided on the outboard motor is represented as a voltage level signal from the angle signal generating circuit 1. This voltage level signal and the triangular wave generated in the triangular wave generating circuit 2 are added by the summing circuit 3. The output level of the summing circuit 3 is compared with the reference voltage in the comparator circuit 6; the comparator circuit 6 creates a signal with a pulse width corresponding to the inclination of the boat body. That is, a signal which has been pulse-width modulated in accordance with the inclination of the boat body is created by the comparator circuit 6. This signal drives the gate of the FET transistor of the motor control circuit 8 via the driver circuit 7 to cause the angle-changing motor to rotate so as to keep the outboard motor level regardless of the inclination of the boat body.

The acceleration detecting circuit 4 detects acceleration by comparing the output level of the angle signal generating circuit 1 with the reference voltage in the acceleration detecting circuit 4. The output level of the acceleration detecting circuit 4 which detects acceleration is fed to the comparator circuit 6 to compare with the reference signal of the comparator circuit 6. In this case, the output signal of the comparator circuit 6 drives the FET gate of the motor control circuit 8 via the driver circuit 7 so that the outboard motor is tilted downward. Thus, the outboard motor is tilted downward by the revolution of the angle-changing motor, causing the bow that has been lifted during the accelerating run to droop.

Furthermore, the motor boat usually has a means for detecting the angle between the boat body and the propeller, that is, the connecting angle between the boat body and the outboard motor. When the connecting angle detecting means detects that the connecting angle is reduced below a predetermined angle, a connecting angle detecting circuit 9 sends the driver circuit 7 a stop signal in order to stop the revolution of the angle-changing motor.

As the stop signal is sent by the connecting angle detecting circuit 9, and the outboard motor is tilted downward, the drive current to the FET to cause the outboard motor to be tilted downward is interrupted via the driver circuit 7. This causes angle-changing motor revolution to stop, preventing the angle-changing motor from being damaged by heat.

An embodiment of this invention will be described in the following, referring to FIGS. 2 through 5.

Figure 2:
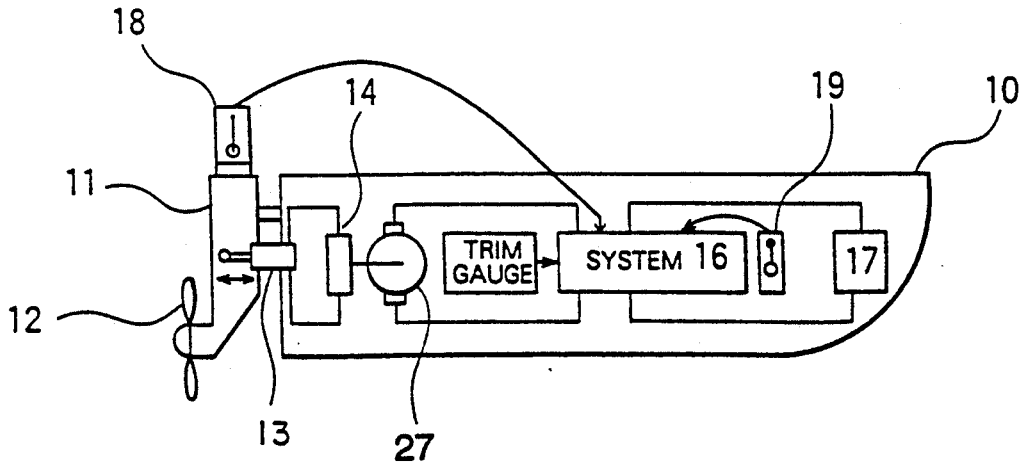
FIG. 2 is a schematic diagram illustrating the automatic planing control system for motor boats.

FIG. 2 is a schematic diagram of an automatic planing control system for motor boats. In the figure, an outboard motor 11 is installed on the stern of a motor boat. A propeller 12 of the outboard motor 11 is driven by an engine (not shown). The angle between the outboard motor 11 and the boat body 10 of a motor boat can be changed by operating a hydraulic cylinder 13, as shown by arrows in the figure. The hydraulic cylinder 13 is driven by a hydraulic pump 14 and a d-c motor 27. A system 16 receives from a battery 17 power for controlling and driving the d-c motor 27, and also receives a voltage level signal in accordance with the inclination of the boat body 10 from an angle sensor 18 provided on the outboard motor 11.

An angle sensor 19 provided on the boat body 10, on the other hand, detects the inclination of the boat body 10 caused by acceleration, and outputs to the system 16 a voltage level signal in accordance with the inclination.

A trim gauge U, comprising a potentiometer of a magnetic resistance element, etc., is used for detecting the connecting angle of the boat body 10 and the propeller, that is, the outboard motor 11. The trim gauge U sends a voltage in accordance with the angle between the boat body 10 and the outboard motor 11 to the output system 16 and to the trim meter in front of the control seat.

Figure 7:
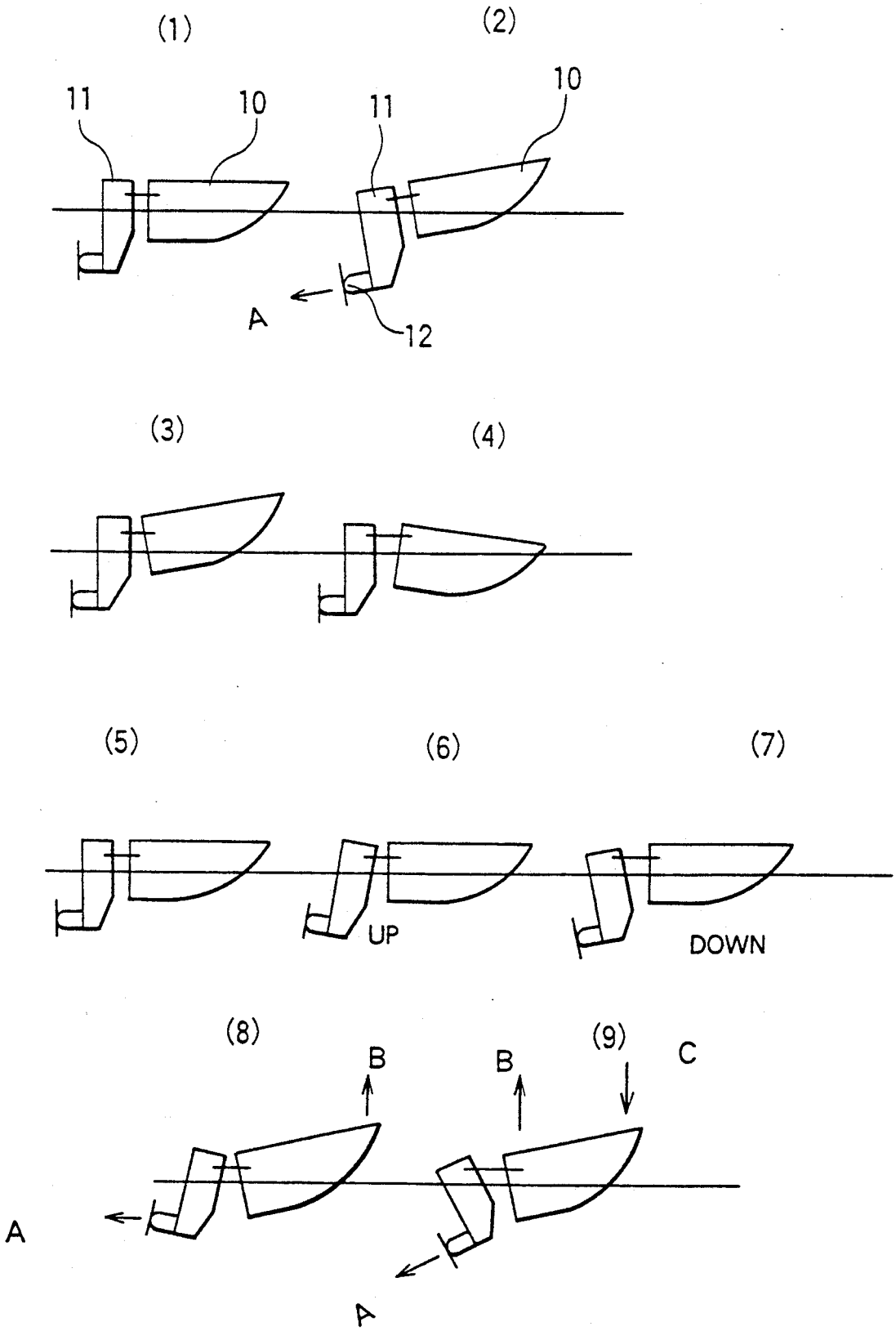
FIG. 7 is a diagram of assistance in explaining the relationship between the motor boat and the outboard motor.

With this arrangement, the angle sensor 18 detects the inclination of the motor boat body 10, and generates a voltage level signal in accordance with the inclination, which is transmitted to the system 16. The system 16 determines whether the boat is running at a constant speed or being accelerated based on the received voltage level signal by means of a control circuit, which will be described later. If the system 16 determines that the boat is running at a constant speed, the hydraulic cylinder 13 is operated to maintain the axis of the propeller 12 of the outboard motor 11 parallel with the surface of the water, regardless of the direction of the bow, as shown in FIGS. 7(3) or (4).

If the system 16 determines that the boat is being accelerated, the hydraulic cylinder 13 is operated first to cause the propeller 12 to be tilted downward to raise the stern, that is, to cause the outboard motor 11 to be driven in the DOWN direction, as shown in FIG., 7(9), in order to keep the boat body 10 level. Then the hydraulic cylinder is again operated to cause the outboard motor 11 to be returned from the DOWN direction.

Next, the relationship between the angle sensor 18 provided on the outboard motor 11 and the output voltage thereof will be described, referring to FIG. 3.

Figure 3:
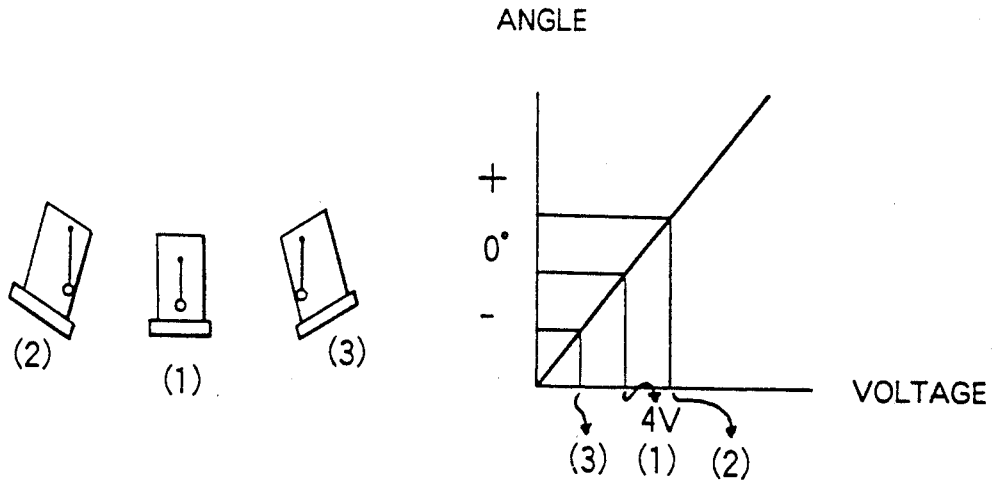
FIG. 3 is a diagram of assistance in explaining the relationship between the angle sensor and voltage.

As shown in FIG. 3(1), when the motor boat body 10 is parallel with the surface of the water, the angle sensor 18 indicates the direction of the vertical, that is, 0°, and is adapted to output 4 volts, for example, as an output voltage.

As shown in FIG. 3(2), when the bow of the boat dips downward with respect to the surface of the water, the output voltage becomes an output higher than the reference voltage of 4 V.

As shown in FIG. 3(3), when the boat bow lifts upward with respect to the surface of the water, the output voltage becomes an output lower than the reference voltage of 4 V.

As for the angle sensor 19 provided on the boat body 10, an output voltage, or a voltage level signal similar to that described in the foregoing description can be obtained.

Next, an example of the control circuit embodying this invention and the time charts thereof will be described, referring to FIGS. 4A, 4B and 5.

Figure 4A:
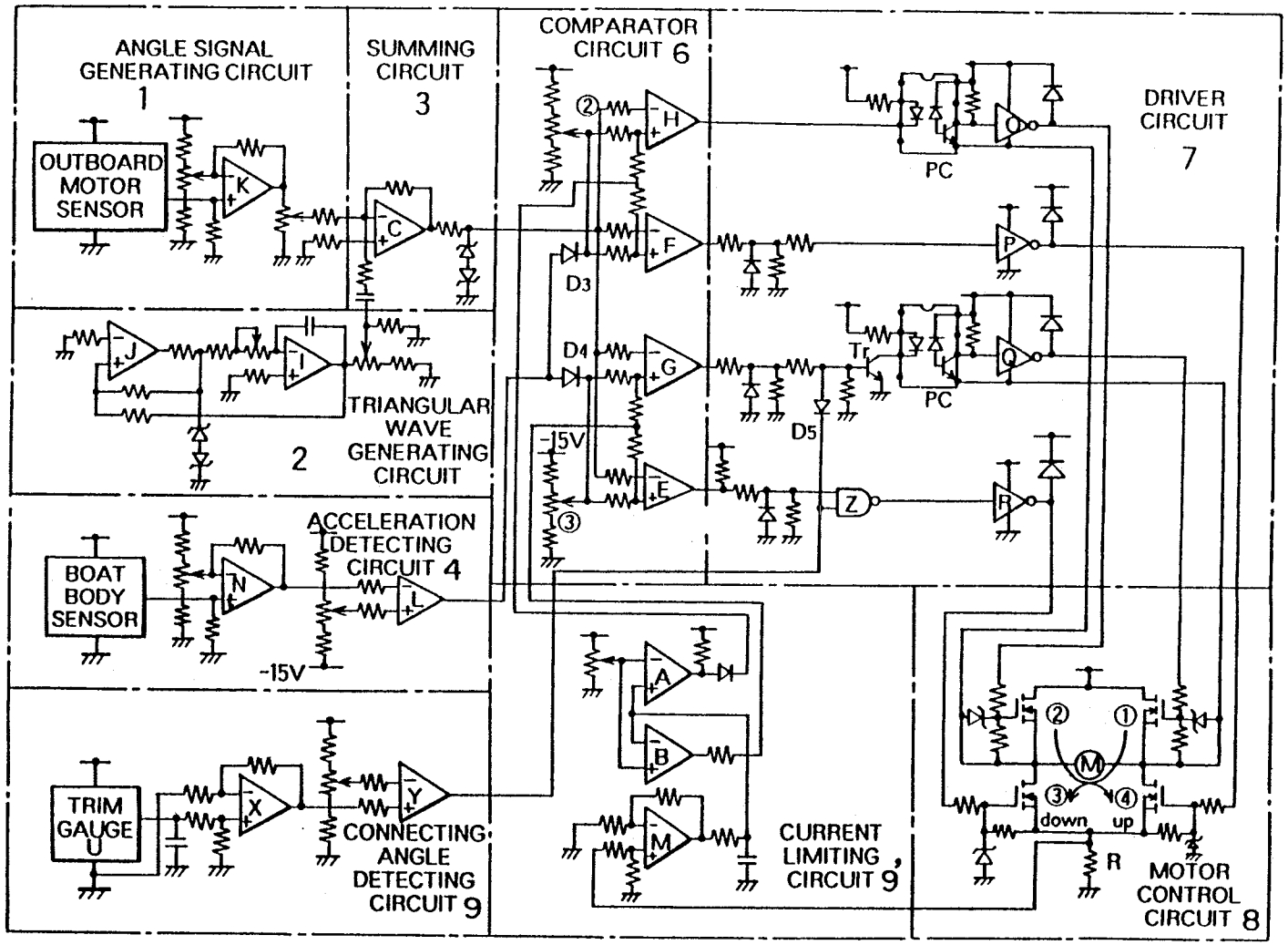
FIG. 4A and 4B are diagrams showing control circuits in this invention.
Figure 4B:
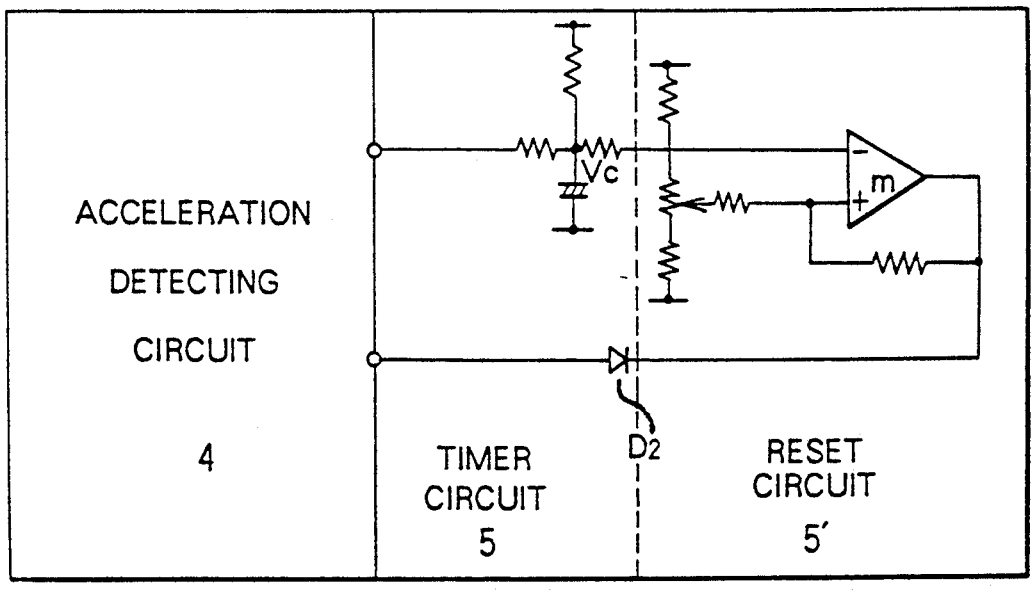

In FIGS. 4A and B, a differential voltage between the voltage level signal detected by an outboard motor sensor S and the reference voltage set by an angle setting variable resistor V is amplified to an appropriate degree by a differential amplifier K of an angle signal generating circuit 1.

A triangular wave generating circuit 2 generates a triangular wave of 20 kHz, for example, by means of operational amplifiers J and I.

A summing circuit 3 adds the output of the differential amplifier K and the output of the operational amplifier I of the triangular wave generating circuit 2 by means of an operational amplifier C. A comparator circuit 6 consists of operational amplifiers H, F, G and E, a positive comparison voltage ②′ applied to the non-inverting terminals of the operational amplifiers H and F, and a negative comparison voltage ③′ applied to the non-inverting terminals of the operational amplifiers G and E. The absolute values of these compared voltages are slightly larger than the amplitude of the triangular wave.

An acceleration detecting circuit 4 consists of a boat body sensor T for detecting acceleration, a differential amplifier N for amplifying the differential voltage between the voltage level signal of the boat body sensor T and the reference voltage set by a variable resistor W setting the acceleration response angle, and an operational amplifier L for comparing the differential voltage amplified by the differential amplifier N with a preset reference voltage. The output of the summing circuit 3 is applied to the inverting terminals of the operational amplifiers H, F, G and E of the comparator circuit 6. The output of the operational amplifier L of an acceleration detecting circuit 4 is applied to the non-inverting terminals of the operational amplifiers H, F, G and E.

The operational amplifiers H and G of the comparator circuit 6 drive the FETs ② and ① comprising the PWM bridge circuit via the photo coupler PC and the driver circuits 0 and Q in the driver circuit 7. The operational amplifiers F and E drive the FETs ④ and ③ via the driver circuits P and R.

The angle-changing motor M is driven by the FETs ①, ③ or ②, ④, causing the outboard motor 11 to move in the DOWN or UP direction.

A connecting angle detecting circuit 9 consists of a trim gauge U for detecting the connecting angle between the boat body 10 and the outboard motor 11 being the prime mover of the motor boat, an operational amplifier X for amplifying the output obtained by the trim gauge U, and an operational amplifier Y for comparing the output amplified by the operational amplifier X with the reference voltage.

The trim gauge U of the connecting angle detecting circuit 9 is constructed so that the detected voltage thereof decreases as the connecting angle becomes smaller. Consequently, the detected voltage drops down to approximately 2.5 V, for example, in the down-blow state. The operational amplifier Y comprising the comparator, whose reference voltage is set so that the operational amplifier Y outputs an L level at a voltage value immediately before the down-blow state is reached, is connected so that the output of the operational amplifier Y is applied to the gate of a transistor $T_r$ via a diode $D_5$ and to the NAND gate Z of the driver circuit 7.

A current limiter circuit 9′ detects a current flowing in the resistor R of a motor control circuit 8, and the detected voltage thereof is appropriately amplified by an operational amplifier M, and sent to the non-inverting and inverting terminals of the operational amplifiers A and B. These operational amplifiers A and B comprise a comparator for comparing input levels with a predetermined reference voltage. That is, when the current flowing in the resistor R becomes larger than a predetermined current level, output signals are produced from the operational amplifiers A and B. These output signals are sent to the non-inverting terminals of the operational amplifiers H and F and to the non-inverting terminals of the operational amplifiers G and H of the comparator circuit 6, preventing excess current from flowing in the FETs ①, ③ or ②, ④ comprising a PWM bridge circuit.

Next, the operation of the control circuit embodying this invention will be described in the following.

Figure 5A:
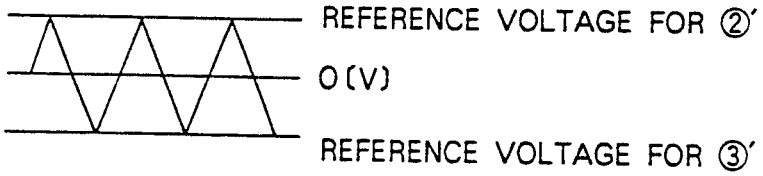
FIG. 5 is a time chart in the control circuit of this invention.
Figure 5B:
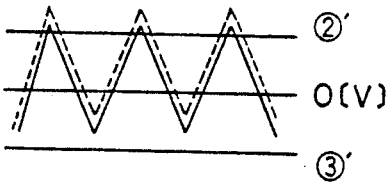
Figure 5C:
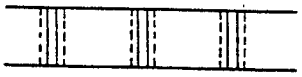
Figure 5D:
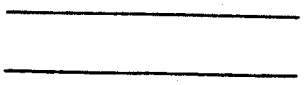

In the constant-speed operation, the angle of the outboard motor sensor S is 0° so long as the boat body 10 remains parallel with the surface of the water, as shown in FIG. 7(1), and an output voltage of 4 V is created, as shown in FIG. 3(1). Consequently, the output voltage of 4 V of the outboard motor sensor S is equal to the reference voltage of 4 V of the differential amplifier K, thus the differential amplifier K produces no outputs. As a result, the output of the triangular wave generating circuit 2 is sent as it is to the comparator circuit 6 through the summing circuit 3. When the relationship between the comparison voltages ②′ and ③′ and the output voltage of the triangular wave generating circuit 2 is determined as shown in FIG. 5*a*, then no output is produced by the operational amplifiers E through H of the comparator circuit 6, and therefore the angle-changing motor M of the motor control circuit 8 is not driven. Consequently, the relationship between the boat body 10 and the outboard motor 11 remains unchanged from that shown in FIG. 7(1).

When the bow of the boat body 11 lifts, as shown in FIG. 7 (2), the output of the outboard motor sensor S becomes a voltage level lower than the voltage obtained when the boat body 10 is parallel with the surface of the water (4 V in the figure), as shown in FIG. 3(3). Consequently, the output of the differential amplifier K is shifted to the negative side. The output of the summing circuit 3 which is the sum of the output of the differential amplifier K and the output of the triangular wave generator 2 is shifted to the positive side by the operational amplifier C, as shown in the time chart in FIG. 5*b*. If the bow lifts further, the output is shifted further, as shown by a dotted line in the figure.

As the output level of the operational amplifier C increases to the positive side, the peak value thereof becomes higher than the comparison voltage ②′.

Consequently, the output levels of the operational amplifiers H and F remain at the L level during the period shown in the time chart c of FIG. 5, that is, during the period in which the peak value is higher than the comparison voltage ②′. The period in which the L level is maintained is therefore proportional to the inclination of the boat body 10. That is, the outputs of the operational amplifiers H and F are pulse-width modulated (PWM) in accordance with the inclination of the boat body 10. The output of the L level is changed to the H level via the driver circuit 7 and applied to the gates of the FETs ② and ④, turning on the FETs ② and ④ to drive the angle-changing motor M. At this time, the motor M is driven in the UP direction in which the outboard motor 11 is tilted upward, as shown in FIG. 7(3). That is, the propeller 12 is kept parallel with the surface of the water. Since the outputs of the operational amplifiers G and E in the comparator circuit 6 at this time are always kept at the H level, as shown in FIG. 5*d*, the outputs of the operational amplifiers G and E are changed to the L level, thus invariably turning off the FETs ① and ③.

Figure 5E:
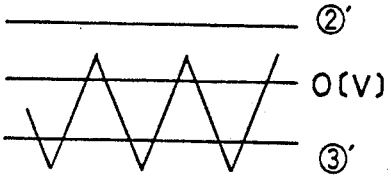
Figure 5F:
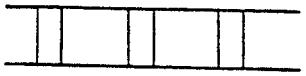

Next, in the constant-speed run, when the boat body 10 pitches in the reverse direction, or in such a direction as to droop the bow downward, the operation opposite to the aforementioned operation is needed. That is, the outboard motor sensor S has a voltage higher than the reference voltage of 4 V, as shown in FIG. 3(2), shifting the output of differential amplifier K to the (+) side. Consequently, the output of the operational amplifier C of the summing circuit 3 becomes (−), the peak value thereof being reduced to a value lower than the comparison voltage ③', as shown in FIG. 5*e*. Thus, the outputs of the operational amplifiers G and E in the comparator circuit 6 become the L level. The period during which the L level is maintained is proportional to the inclination of the boat body 10. That is, the outputs of the operational amplifiers G and E are pulse-width modulated in accordance with the inclination of the boat body 10. This output of the L level is changed to the H level via the driver circuit 7 and applied to the gates of the FETs ① and ③, turning on the FETs ① and ③ to drive the angle-changing motor M. The driving direction of the angle-changing motor M at this time is in the direction in which the outboard motor 11 is tilted down, as shown in FIG. 7(4), or in which the axis of the propeller 12 is kept parallel with the surface of the water. At this time, the outputs of the operational amplifiers H and F in the comparator circuit 6 are always kept at the H level, and changed to the L level via the driver circuit 7, thus invariably turning off the FETs ② and ④.

In this way, even when the bow pitches either upward or downward in the constant-speed run, the outboard motor 11 is automatically kept parallel with the surface of the water by means of the outboard motor sensor S provided on the outboard motor 11.

Next, the planing control in the accelerating run of the motor boat will be described in the following.

When the motor boat is being accelerated, the boat body 10 pitches upward to a large degree, causing the bow to rise upward. In this state, if the boat body 10 and the outboard motor 11 are fixed in the relative position, the direction of the thrust A of the propeller 12 is misaligned with the direction of travel of the boat, as shown in FIG. 7(2), deteriorating the driving efficiency of the boat.

During the accelerating run, if the outboard motor 11 is tilted in the UP direction to lift the bow in the B direction so that the propeller 12 is kept horizontal, as shown in FIG. 7(3), as in the case where the bow pitches upward in the constant-speed run, this would lead to a delay in planing, as shown in FIG. 7(8). To cope with this, the outboard motor 11 is temporarily moved in the DOWN direction (the direction shown in FIG. 7(9)) for a predetermined time in the accelerating run to cause the bow to move downward in the C direction and the stern to move upward in the B direction. Thus, the boat body 10 is brought to the planing state, rapidly reaching the stabilized run.

To cause the outboard motor 11 to perform the aforementioned functions, an acceleration detecting circuit 4 having a boat body sensor T is provided in the control circuit.

The output of the boat body sensor T provided on the boat body 10 is inputted to the inverting terminal of the operational amplifier L via the differential amplifier N. The boat body sensor T has characteristics similar to the output of the outboard motor sensor S described above, and generates a voltage in accordance with the inclination of the boat body 10. A reference voltage for detecting the acceleration that is set to a certain voltage by a variable resistor W for setting an acceleration response angle is sent to the non-inverting terminal of the operational amplifier L. The reference voltage set by the acceleration response angle setting variable resistor W for detecting acceleration is compared with the output of a differential amplifier N that is sent to the inverting terminal of the operational amplifier L. The reference voltage for detecting acceleration described above is set in an outboard motor sensor S at a value lower than the output range for detecting the constant-speed running state so that the output of the operational amplifier L becomes the L level so long as the boat body 10 is kept within a predetermined angle. Consequently, during the constant-speed run, the output of the operational amplifier L is the L level, and diodes D3 and D4 have no effects on the operational amplifiers E through H in the comparator circuit 6 as long as the output of the operational amplifier L is the L level.

Now, as the motor is accelerated, the output of the boat body sensor T is reduced to a level substantially below that in the constant-speed travelling. When this value is applied to the inverting terminal of the operational amplifier L via the differential amplifier N and reduced to a level lower than the reference voltage sent to the non-inverting terminal of the operational amplifier L of the acceleration detecting circuit 4, the output level of the operational amplifier L become the H level. This H-level output is sent to the comparison voltage points ②' and ③' to clamp the reference voltage of the operational amplifiers E through H in the comparator circuit 6 at (+). As a result, the outputs of the operational amplifiers H and F become the H level and changed to the L level in the driver circuit 7, thus turning off the FETs ② and ④.

The outputs of the operational amplifiers G and E become the L level and changed to the H level in the driver circuit 7, turning on the FETs ① and ③. Thus, the angle-changing motor M causes the outboard motor 11 to rotate in the DOWN direction, forcing the bow toward the C direction shown in FIG. 7(9).

By causing the outboard motor 11 to turn in the DOWN direction, the boat body 10 approaches the planing state while the output of the boat body sensor T is returned to the steady-state value. At this moment, when the output of the boat body sensor T rises above the reference voltage (the voltage set by the acceleration response angle setting variable resistor W) of the acceleration detecting circuit 4, the output of the operational amplifier L is returned to the L level, and the control circuit is returned to the steady-state operation.

In the accelerating run, since the acceleration detecting circuit 4 is operated prior to the angle signal generating circuit 1, the angle-changing motor M is caused to rotate in the DOWN direction to turn the bow in the horizontal direction as the inclination of the boat body 10 reaches a predetermined angle, even when the motor boat is accelerated slowly to pitch the bow of the boat body 10 upward.

The trim gauge U in the connecting angle detecting circuit 9 detects the connecting angle between the boat body 10 and the propeller, that is, the outboard motor 11, and generates a detected voltage that is in inverse proportion to the connecting angle. In the down-blow state, the trim gauge U sends a detected voltage that is dropped to about 2.5 V. Upon receiving a detected voltage immediately before the down-blow state, an L-level output signal is produced from the operational amplifier Y. As this L-level output signal is generated, the transistor Tr of the driver circuit 7 is kept in the OFF state. Consequently, the drive signals of the FETs ① and ③ that cause the motor M to rotate in the DOWN direction are cut off, causing the rotation of the angle-changing motor M to stop. With this, the angle-changing motor M is prevented from being damaged by the heat produced by excess current flowing in the motor M.

As the motor boat gains speed, and begins planing, the signals from the angle signal generating circuit 1 drive the FETs ② and ④ to cause the angle-changing motor M to rotate in the UP direction. Along with this, the detected voltage of the trim gauge U rises, and the L-level output signal from the operational amplifier Y disappears. That is, the connecting angle detecting circuit 9 is reset, shifting to the aforementioned automatic control state to perform control in the normal operation.

To the acceleration detecting circuit 4, a timer circuit and a reset circuit 5' as shown in FIG. 4 B may be added. That is, when the accelerating run continues for more than a predetermined time, the charging voltage of a capacitor C rises above the reference voltage of the reset circuit 5'. This causes the output of an operational amplifier m to become the L level, which in turn automatically resets the circuit by forcibly decreasing the reference voltage of the acceleration detecting circuit 4. That is, the period in which the outboard motor 11 is tilted downward can be freely set by changing the capacitance of the capacitor C.

Next, an example of the FET bridge protection circuit in the automatic planing control system will be described, referring to FIG. 6.

Figure 6:
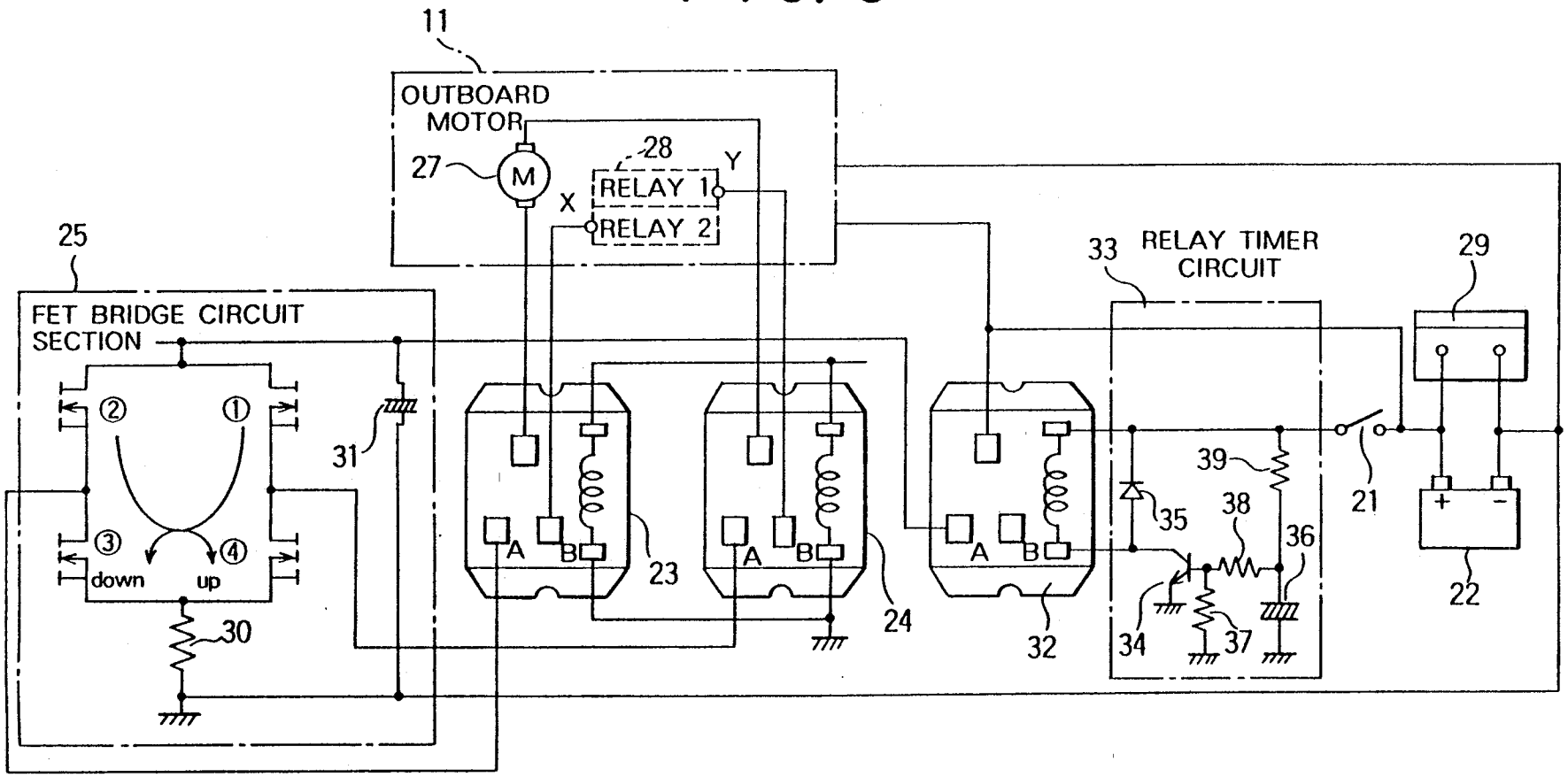
FIG. 6 is a diagram of assistance in explaining the FET bridge protection circuit for the automatic planing control system of this invention.
Figure 8:
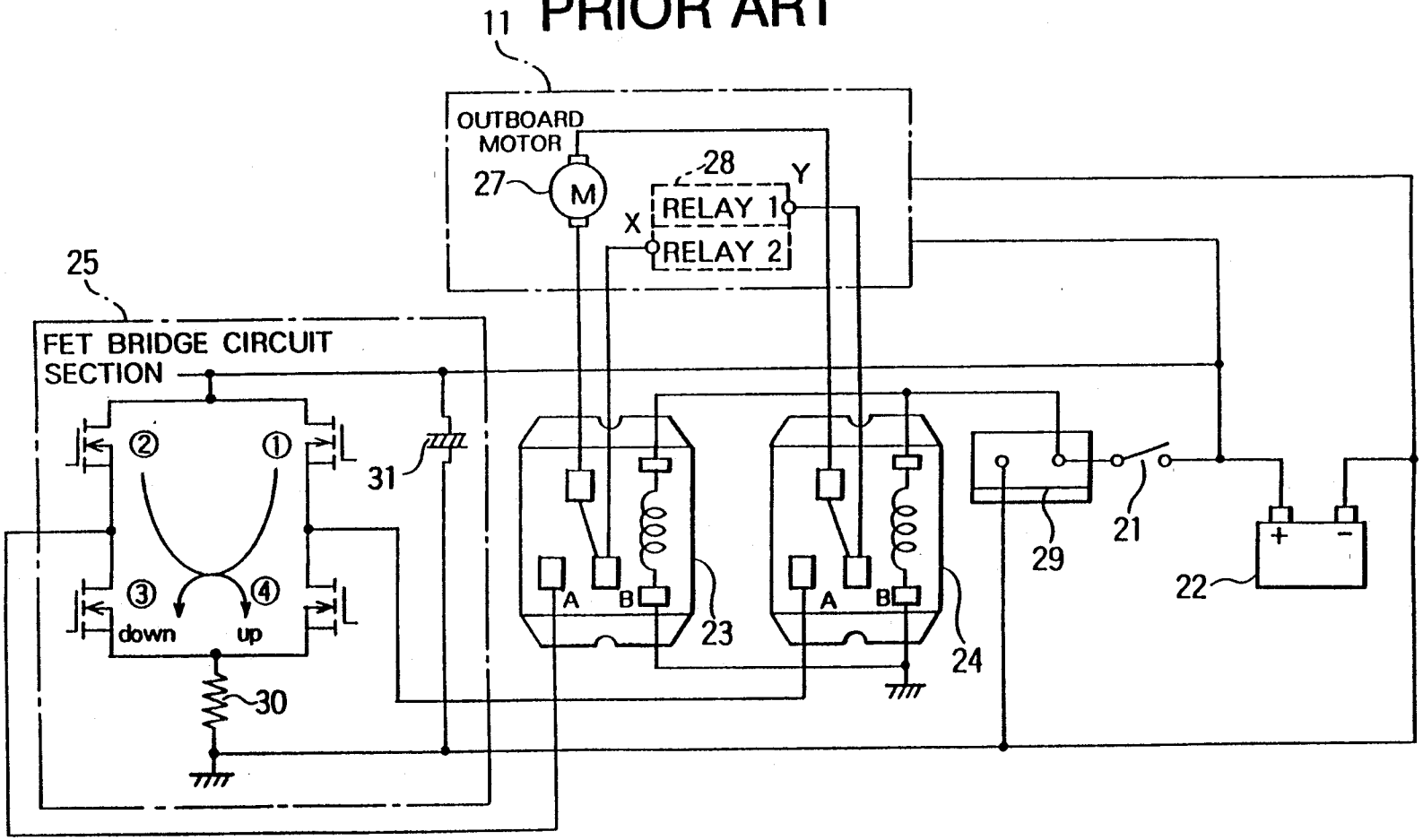
FIG. 8 PRIOR ART
FIG. 8 is a diagram of assistance in explaining the FET bridge protection circuit for the automatic planing control system used in the prior art.

In FIG. 6, reference numeral 11, and 21 through 31 correspond to like numerals in the prior art shown in FIG. 8. Numeral 32 refers to a relay for feeding power; 33 to a delay relay timer circuit; 34 to a transistor; 35 to a diode; 36 to a capacitor; 37 through 39 to resistors, respectively.

This invention is different from the prior art shown in FIG. 8 in that a relay 32 and a relay timer circuit 33 are newly added to feed the voltage of a battery 22 to an FET bridge circuit section 25, etc. via the contact A of the relay 32, and that after at a predetermined time has elapsed after the changeover switch 21 is turned on the relay 32 is energized by a relay timer circuit 33.

Therefore, operations after the relay 32 is energized and the contact thereof is connected to the A side are exactly the same as those with the prior art shown in FIG. 8. As the changeover switch 21 is turned on, the voltage of the battery 22 is applied to the RC circuit comprising a resistor 39 and a capacitor 36 via the changeover switch 21. The transistor 34 is turned on after the lapse of a time determined by the time constant of the RC circuit, energizing the relay 32.

The time elapsed before the transistor 34 is turned on is set to a time duration longer than about 1 second before the voltages of the drive circuit for driving the FET transistors ① through ④ of the FET bridge circuit section described above are stabilized, to approximately 3 seconds, for example. Consequently, as the relay 32 is energized, the voltages of control circuits, such as the drive circuit for driving the FET transistors ① through ④ are stabilized at the point of time at which the voltage of the battery 22 is fed to the FET bridge circuit section 25. Thus, the FET bridge circuit section 25 is protected since no unstable voltages are applied to the FET bridge circuit section 25.

Even if the battery 22 is connected to the circuit power terminal 29 by bringing the changeover switch 21 to the ON state, the voltage of the battery 22 is fed to the FET bridge circuit section 25 after the lapse of a predetermined time from the actuation of the relay timer circuit 33. Thus, the FET bridge circuit section 25 is protected in such a state.

As described above, this invention makes it possible to automatically keep the propeller of the outboard motor parallel with the surface of the water, irrespective of the upward and downward motion of the bow during the constant-speed run because the angle-changing motor for driving the outboard motor vertically is controlled in accordance with the inclination of the boat body.

During the accelerating run, including slow acceleration, the outboard motor is forcibly tilted in the direction to pitch downward. As a result, planing can be reached quickly.

Moreover, the heat resulting from the continuation of the down-blow state in which excess current flows in the angle-changing motor is avoided, and the angle-changing motor is prevented from being damaged by overheating.

What is claimed is:

1. An automatic planing control system for motor boats, the system comprising:

an angle signal generating circuit for generating an angle signal by detecting an inclination of a boat body, a triangular wave generating circuit, a summing circuit for adding output level signals sent by said angle signal generating circuit and said triangular wave generating circuit an acceleration detecting circuit for detecting whether said boat body is being accelerated by comparing output level of said angle signal generating circuit with a reference voltage, a comparator circuit for comparing an output level of said summing circuit and an output level of said acceleration detecting circuit with a reference voltage, a driver circuit for driving said angle-changing motor in accordance with a signal sent by said comparator circuit, an amplitude of said signal corresponding to the inclination of said boat body, and a motor control circuit for controlling said angle-changing motor for changing an angle between an outboard motor and said boat body by means of said driver circuit, so that control is effected to keep said outboard motor in a predetermined attitude.

2. An automatic planing control system for motor boats as set forth in claim 1 wherein: said acceleration detecting circuit consists of a timer circuit for detecting the continuation of acceleration for longer than a predetermined time, and a reset circuit for forcibly reducing the reference voltage of said acceleration detecting circuit by a detecting signal of said timer circuit.

3. An automatic planing control system for motor boats as set forth in claim 1 wherein: said acceleration detecting circuit detects the inclination of said boat body resulting from acceleration, and generates an acceleration signal when the inclination of said boat body exceeds a predetermined angle.

4. An automatic planing control system for motor boats as set forth in claim 1 or claim 3 further comprising: a connecting angle detecting circuit for detecting a connecting angle between said outboard motor and said boat body and changing over said controlling of said driver circuit to discontinue said angle-changing motor operation when said detected connecting angle falls below a predetermined connecting angle.

* * * * *